US005970584A

United States Patent [19]

Akahane et al.

[11] Patent Number: 5,970,584

[45] Date of Patent: Oct. 26, 1999

[54] SHEET FIXING MECHANISM

[76] Inventors: Buhei Akahane; Tosiki Akahane, both of 623 Ooaza Koizumi, Ueda, Nagano, 386-11, Japan

[21] Appl. No.: 08/907,651

[22] Filed: Aug. 11, 1997

[30] Foreign Application Priority Data

Aug. 12, 1996 [JP] Japan ..... 8-212397

[51] Int. Cl.[6] ..... B42F 3/00

[52] U.S. Cl. ..... 24/67 CF; 24/67 R; 24/67.3

[58] Field of Search ..... 24/67 CF, 67 AR, 24/67.3, 67 R

[56] References Cited

U.S. PATENT DOCUMENTS

| | | | |
|---|---|---|---|
| 734,991 | 7/1903 | Sterki | 24/458 |
| 2,460,650 | 2/1949 | Nemeth | 24/67 CF |
| 2,493,276 | 1/1950 | Thurston | 24/67 AR |
| 2,843,901 | 7/1958 | Bukowski | 24/67 CF |
| 3,524,225 | 8/1970 | Trikilis | 24/67 R |
| 4,268,000 | 5/1981 | Ulm | 24/67 AR |
| 5,479,682 | 1/1996 | Hendrikx et al. | 24/67.3 |

FOREIGN PATENT DOCUMENTS

| | | | |
|---|---|---|---|
| 1001037 | 12/1976 | Canada | 24/67 R |
| U-55-25976 | 2/1980 | Japan . | |
| 0115133 | 7/1968 | Norway | 24/67 R |

*Primary Examiner*—Victor N. Sakran
*Attorney, Agent, or Firm*—Birch, Stewart, Kolasch & Birch, LLP.

[57] ABSTRACT

Buckling plates are provided at comers or sides of a base plate. Each bucking plate selectively buckles between a fixing position, at which a corner or side of a sheet placed on the base plate is fixed, and a release position, at which the corner or side of the sheet is released. This reduces the number of parts and simplifies the structure, thus reducing cost. Further, this simplifies operation and fixes the sheet on a flat surface of the base plate in a stable manner.

20 Claims, 8 Drawing Sheets

SHEET FIXING MECHANISM

BACKGROUND OF THE INVENTION

1. Field of the Invention

This invention relates to a sheet fixing mechanism for a drawing board and the like, used for fixing a drawing sheet on the drawing board.

2. Description of the Relevant Art

A known conventional sheet-fixing mechanism used for fixing a drawing sheet on a drawing board is disclosed in Japanese Utility-Model Publication No. 55 (1980)-25976.

According to this conventional art, the sheet fixing mechanism comprises a base, a press member as a bent rod with its one end pivotally attached to the base, and a spring biasing the press member in a sheet-pressing direction. The sheet fixing mechanism is attached to one portion on the base plate constituting a drawing board. When a drawing sheet is fixed on the drawing board, the drawing sheet is held and fixed between the base and the press member.

However, the conventional sheet fixing mechanism has the following problems.

Firstly, the number of parts constituting the sheet fixing mechanism is large, and further the structure of the sheet fixing mechanism is complicated. This increases cost, and cannot provide a drawing board at a low price.

Secondly, when a drawing sheet is fixed, the press member must be lifted up against the resilience of the spring. Such operation is especially troublesome for a child.

Thirdly, as the sheet fixing mechanism is provided only at one portion, the drawing sheet cannot be fixed in a stable manner. Further, as the drawing sheet is placed on the base, the drawing sheet cannot be fixed on a flat surface.

SUMMARY OF THE INVENTION

The present invention has its object to provide a low-price sheet fixing mechanism which reduces cost by reduction of the number of parts and simplification of the structure.

Further, another object of the present invention is to provide a sheet fixing mechanism which realizes simple operation such as single-touch operation easily made by a child or the like.

Further, another object of the present invention is to provide a sheet fixing mechanism which fixes four corners of a drawing sheet on a flat surface of a base plate, in a stable manner.

According to the present invention, the foregoing object is attained by providing a sheet fixing mechanism for a drawing board, comprising: a base plate on which a sheet is placed; and a buckling plate, being selectively buckled between a fixing position at which a corner or a side of the sheet placed on said base plate is fixed, and a release position at which the corner or side of the sheet is released, and being provided at least at one corner or a side of said base plate.

In the above construction, since the buckling plates can be buckled away from the base plate (drawing sheet) by moving the buckling plates to the release positions, the drawing sheet can be inserted between the respective buckling plates and the base plate. Further, the buckling plates are buckled to the fixing positions by pressing the respective buckling plates in a state where the drawing sheet is inserted between the buckling plates and the base plate, thus the drawing sheet is held and fixed between the buckling plates and the base plate.

Other objects and advantages besides those discussed above shall be apparent to those skilled in the art from the description of a preferred embodiment of the invention which follows. In the description, reference is made to accompanying drawings, which form a part thereof, and which illustrate an example of the invention. Such example, however, is not exhaustive of the various embodiments of the invention, and therefore reference is made to the claims which follow the description for determining the scope of the invention.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings. Note that the drawings are for purpose of assistance in understanding of the invention, but not intended to define the limits of the invention. Further, to avoid obscurity of the invention, detailed description of well-known parts will be omitted.

First, the structure of a sheet fixing mechanism according to an embodiment of the present invention will be described with reference to FIGS. 1 to 6.

Figure 3:
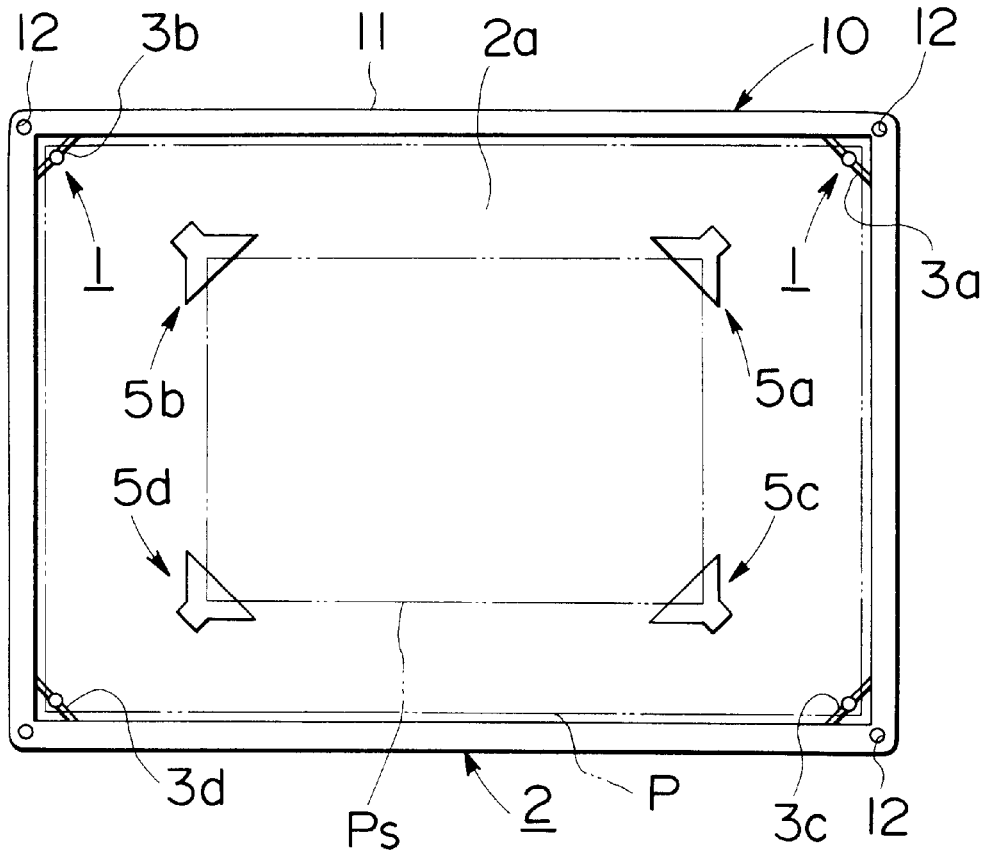
FIG. 3 is a plan view showing a drawing board having the sheet fixing mechanism.

FIG. 3 is a plan view showing a drawing board 10. The drawing board 10 has a base plate 2 including a rectangular base-plate main body 2*a* having a uniform thickness and a frame 11 having a uniform width and a thickness, on a peripheral portion of the base-plate main body 2*a*. The frame 11 has circular aligning concave members 12 on four corners of its upper surface, and has circular aligning convex members 13 on the rear surface, corresponding to the positions of the concave members 12 at the four corners, so that a plurality of drawing boards 10 can be placed one upon another while being aligned.

Figure 2:
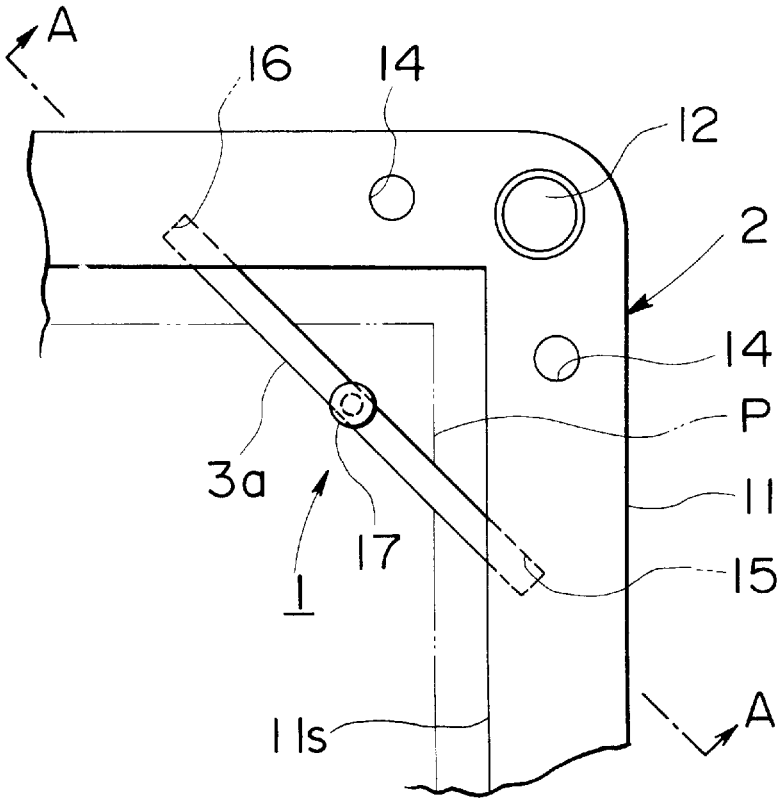
FIG. 2 is a plan view showing the significant part of the sheet fixing mechanism.

In FIG. 2, reference numeral 14 denotes an insertion hole through which a cord or the like can be inserted.

Figure 1:
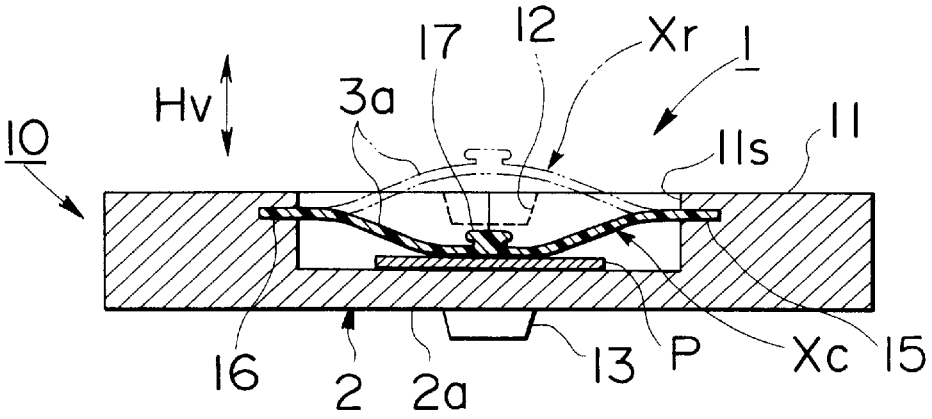
FIG. 1 is a cross-sectional view showing a significant part of a sheet fixing mechanism according to an embodiment of the present invention, cut along a line I—I in FIG. 2.

A pair of opposing support concave members 15 and 16 are formed on side surfaces 11*s* of the frame 11, a predetermined distance away from the corner of the frame 11. On the other hand, four buckling plates 3*a* to 3*d* (represented by 3*a*) are prepared. The buckling plate 3*a*, of flexible synthetic resin, has a long and narrow shape with a uniform thickness. The buckling plate 3*a* has a knob 17 integrally formed at its center. The both ends of the buckling plate 3*a* are inserted into the support concave members 15 and 16. In this case, the length of the buckling plate 3*a* is longer than the distance between the support concave members 15 and 16, so that when the ends of the buckling plate 3*a* are inserted into the support concave members 15 and 16, the buckling plate 3*a* is bent. Then, as shown in FIG. 1, the buckling plate 3*a* moves in a vertical direction Hv with respect to the base plate 2, i.e., the buckling plate 3*a* selectively buckles between a release position Xr above the base plate 2 and a fixing position Xc beneath the release position Xr. When the buckling plate 3*a* is at the fixing position Xc, the central portion of the buckling plate 3*a* presses the upper surface of the base plate 2. Similarly, the other buckling plates 3*b* to 3*d* respectively have ends to be inserted into other support concave members 15 and 16.

Figure 4:
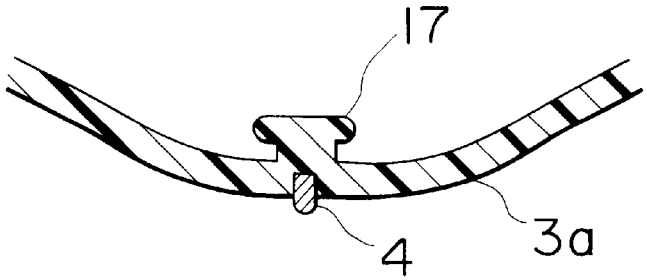
FIG. 4 is a cross-sectional view showing another example of a buckling plate of the sheet fixing mechanism.

Note that the respective buckling plates 3*a* to 3*d* are formed integrally with the base plate 2 (frame 11), or the buckling plates may be formed of metal material. Further, as shown in FIG. 4, a projection 4 may be provided under the buckling plate 3*a*. In this case, the projection 4 has a rounded distal end so as to concentrate the pressing force of the buckling plate on one spot when fixing a sheet P, or the projection 4 has a sharp distal end so as to pierce the sheet P. Note that the number of the projection 4 may be two or more. Further, instead of using the projection 4, the bottom surface of the buckling plate 3*a* may be coated with adhesive material, attachable and removable with respect to the sheet P, or the adhesive material may be attached to the bottom surface, otherwise, the entire buckling plate 3*a* may be integrally formed with the adhesive material.

Figure 5:
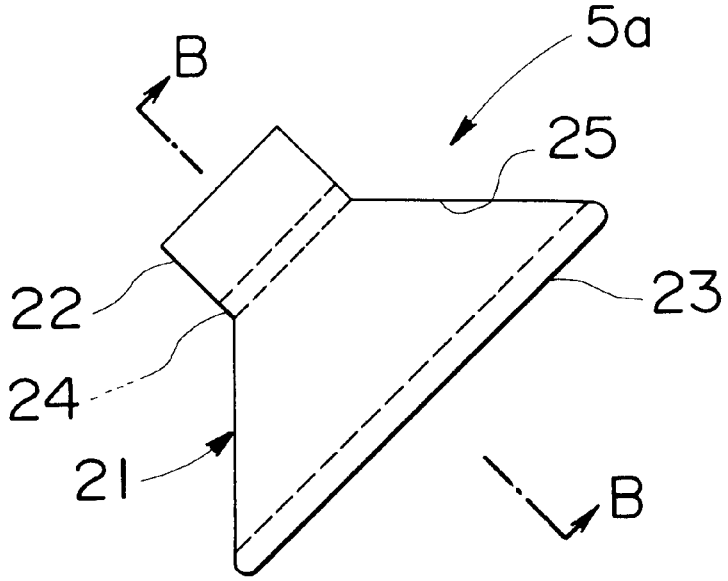
FIG. 5 is a plan view showing a fixing member provided on a base plate of the drawing board.
Figure 6:
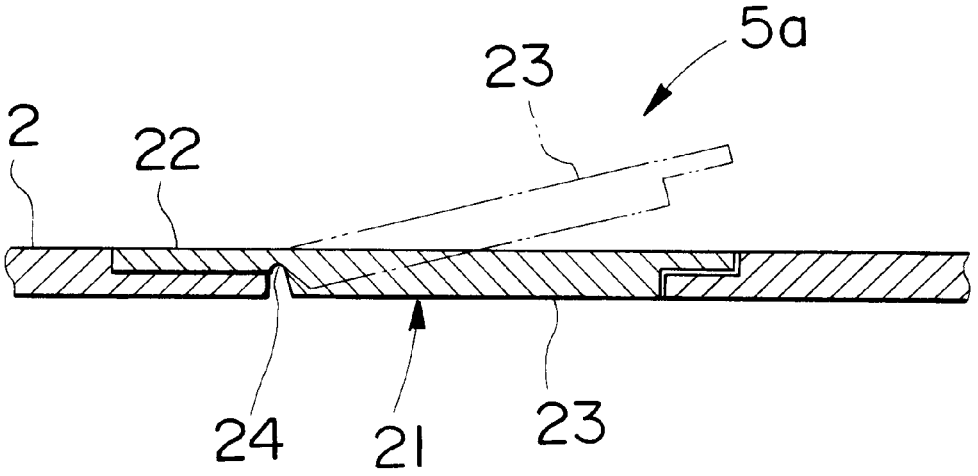
FIG. 6 is a cross-sectional view showing the fixing member, cut along a line VI—VI in FIG. 5.

On the other hand, the base plate 2 has fixing members 5*a* to 5*d* (represented by 5*a*), for fixing a comparatively small drawing sheet Ps at its four corners. As shown in FIGS. 5 and 6, the fixing member 5*a* has a tongue 21 of elastic synthetic resin, integrally formed with the fixing member. The tongue 21 has a fixed base 22 to be attached to the base plate 2, a movable tongue 23 with a free end portion, and a thin portion 24 between the fixed base 22 and the movable tongue 23. The movable tongue 23 can be resiliently bent with respect to the fixed base 22. On the other hand, the base plate 2 has an opening 25 which contains the movable tongue 23. The movable tongue 23 is placed in the opening 25, and the fixed base 22 is fixed on the base plate 2 with adhesive or the like. In this case, the upper surface of the base plate 2 and the upper surface of the tongue 21 are positioned on the same plane. Further, as shown in FIG. 6, the end of the movable tongue 23 and the base plate 2 are overlapped with each other. The other fixing members 5*b* to 5*d* have the same construction as that of the fixing member 5*a*.

Next, the function of the sheet fixing mechanism according to the present embodiment will be described with reference to FIGS. 1 to 6.

When the sheet fixing mechanism is used, the knob 17 is manually lifted up, and the buckling plate 3*a* is buckled to the release position Xr as represented by an alternate long and two short dashed line in FIG. 1. This is performed with respect to the four buckling plates 3*a* to 3*d*. Thus, the four corners of the sheet (drawing sheet) P, placed on the base plate main body 2*a*, are inserted between the buckling plates 3*a* to 3*d* and the base plate 2.

In this state, the buckling plate 3*a* is pushed down, then the buckling plate 3*a* is buckled to the fixing position Xc as represented by a solid line in FIG. 1. Also, this is performed with respect to the four buckling plates 3*a* to 3*d*. The four corners of the sheet P are held and fixed between the buckling plates 3*a* to 3*d* and the base plate 2. Note that to remove the sheet P, it is required only to lift up the knob 17. Then, the buckling plate 3*a* is buckled to the release position Xr, away from the sheet P. In this manner, the sheet P can be easily attached and removed with respect to the drawing board 10 with simple operation.

On the other hand, when the small sheet Ps is attached to the drawing board 10, one lifts the movable tongue 23 upward to a position as represented by an alternate long and two short dashed line in FIG. 6. The corner of the sheet Ps is inserted between the end of the movable tongues 23 and the base plate 2. Then, the movable tongue 23 is returned to the initial position. The corner of the sheet Ps is held and fixed between the distal end of the movable tongue 23 and the base plate 2.

Next, the sheet fixing mechanism according to modifications will be described with reference to FIGS. 7 to 14.

Figure 7:
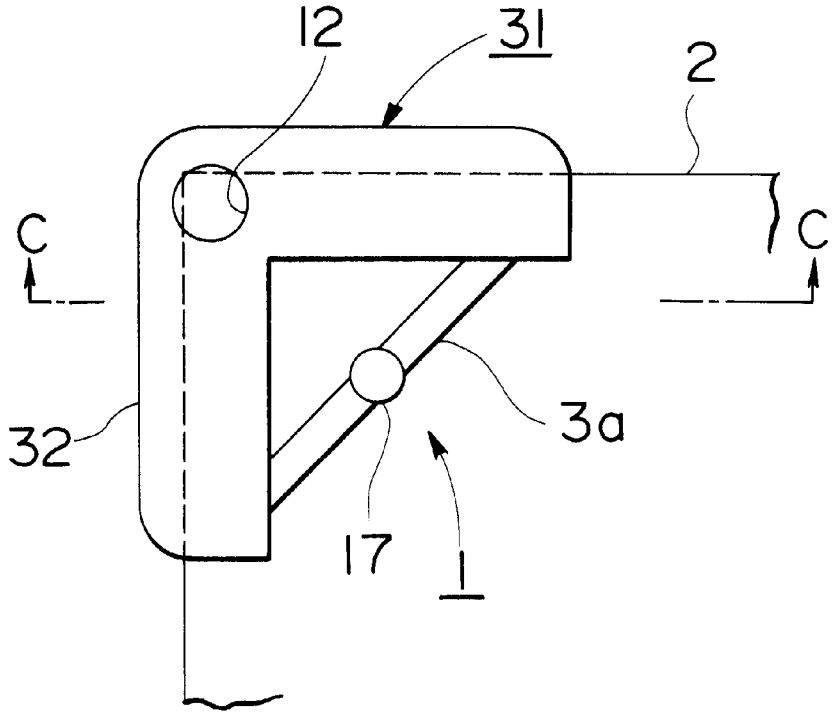
FIG. 7 is a plan view showing a sheet fixing unit of the sheet fixing mechanism according to a modification.
Figure 8:
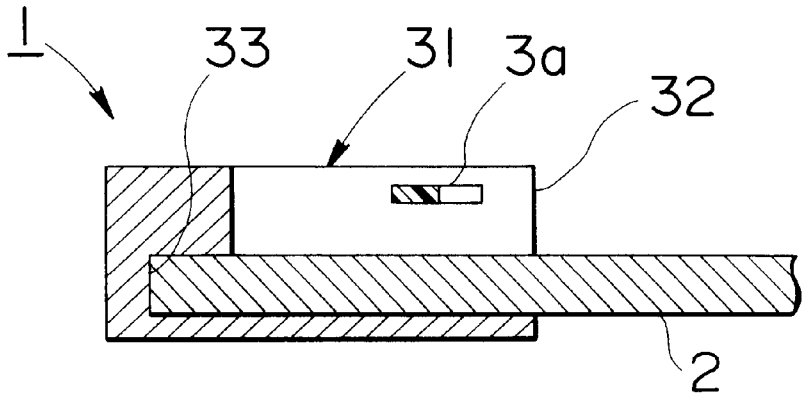
FIG. 8 is a cross-sectional view showing the sheet fixing unit, cut along a line VIII—VIII in FIG. 7.

FIGS. 7 and 8 show a modification using four sheet fixing units 31, formed separately from the base plate 2. In this modification, the base plate 2 lacks the frame 11. Each sheet fixing unit 31 has an L-shaped fixing-unit main body 32, and a concave engaging portion 33 at a lower part of the fixing-unit main body 32. Each corner of the base plate 2 is inserted into the engaging portion 33, and fixed by using adhesive or a screw. The fixing-unit main body 32 is provided with the buckling plate 3*a*, having the same structure as that shown in FIGS. 1 and 2, at its upper portion.

Figure 9:
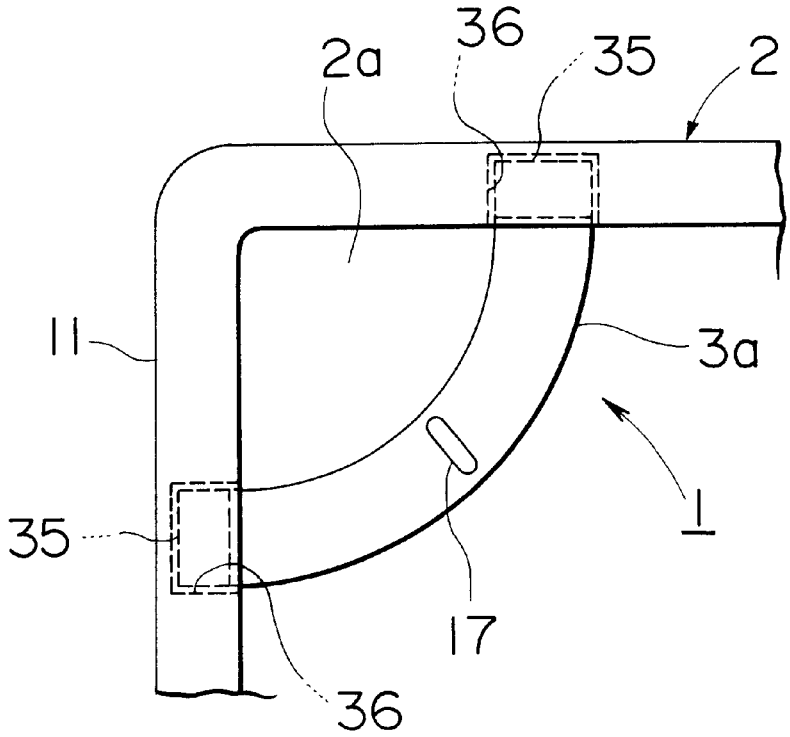
FIG. 9 is a plan view showing a significant part of the sheet fixing mechanism according to another modification.
Figure 10:
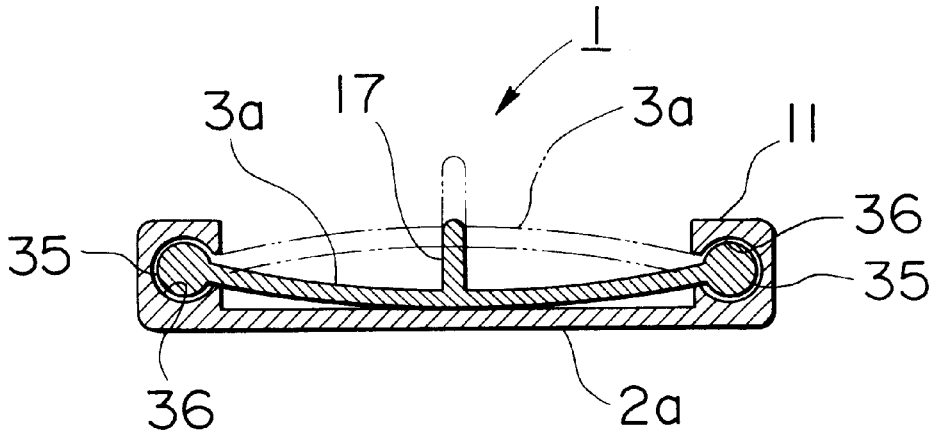
FIG. 10 is a cross-sectional view showing the sheet fixing mechanism including the buckling plate.

On the other hand, FIGS. 9 and 10 show another modification in which the buckling plates 3*a* to 3*d* are pivotally attached to the base plate 2 (frame 11). In this case, a cylindrical roller 35 is integrally formed at both ends of the buckling plate 3*a*, and a roller holder 36 which pivotally supports the roller 35 is provided in the frame 11. In this modification, the buckling plate 3*a* is arc-shaped, and the shape of the knob 17 is changed.

Figure 11:
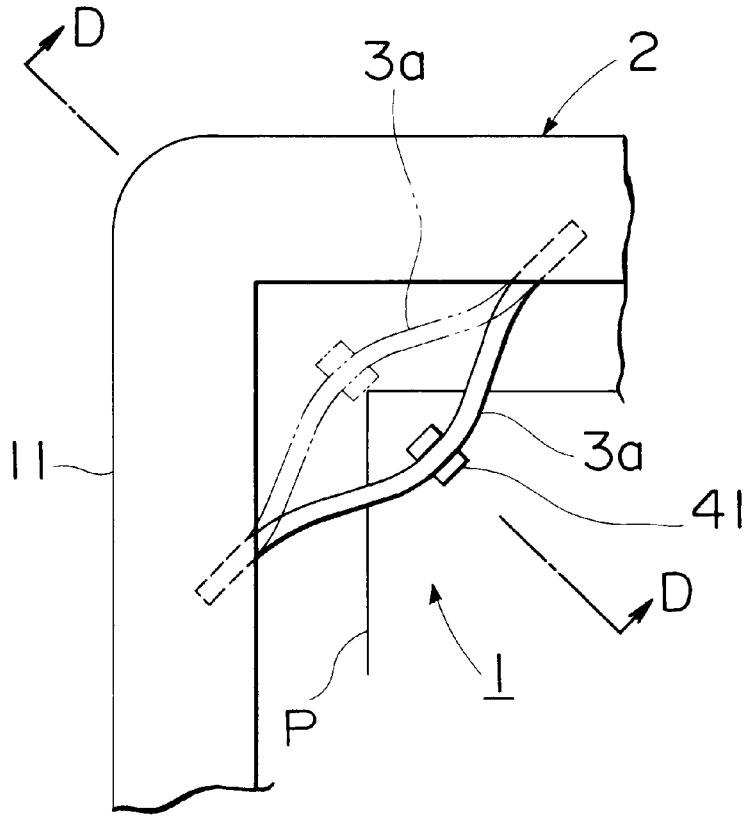
FIG. 11 is a plan view showing a significant part of the sheet fixing mechanism according to another modification.
Figure 12:
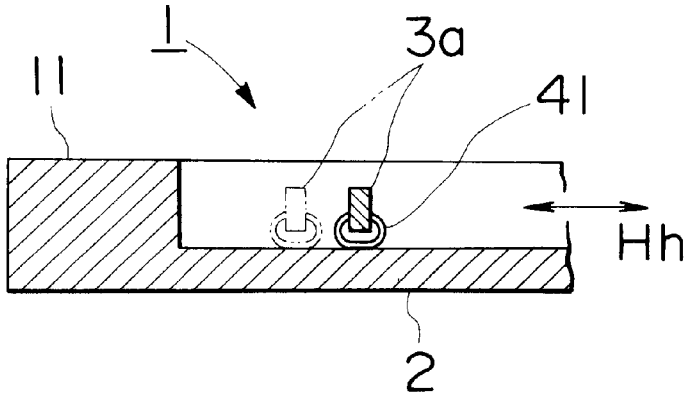
FIG. 12 is a cross-sectional view showing the sheet fixing mechanism, cut along a line XII—XII in FIG. 11.

On the other hand, FIGS. 11 and 12 show another modification in which the buckling plate 3*a* is moved in a horizontal direction Hh parallel to the surface of the base plate 2. The basic structure of the fixing mechanism is the same as that of the embodiment shown in FIGS. 1 and 2. The difference from the embodiment in FIGS. 1 and 2 is that the moving direction of the buckling plates 3*a* to 3*d* is 90-changed to the horizontal direction, and that an elastic press ring 41 is provided at a low and central portion of each buckling plate.

Figure 13:
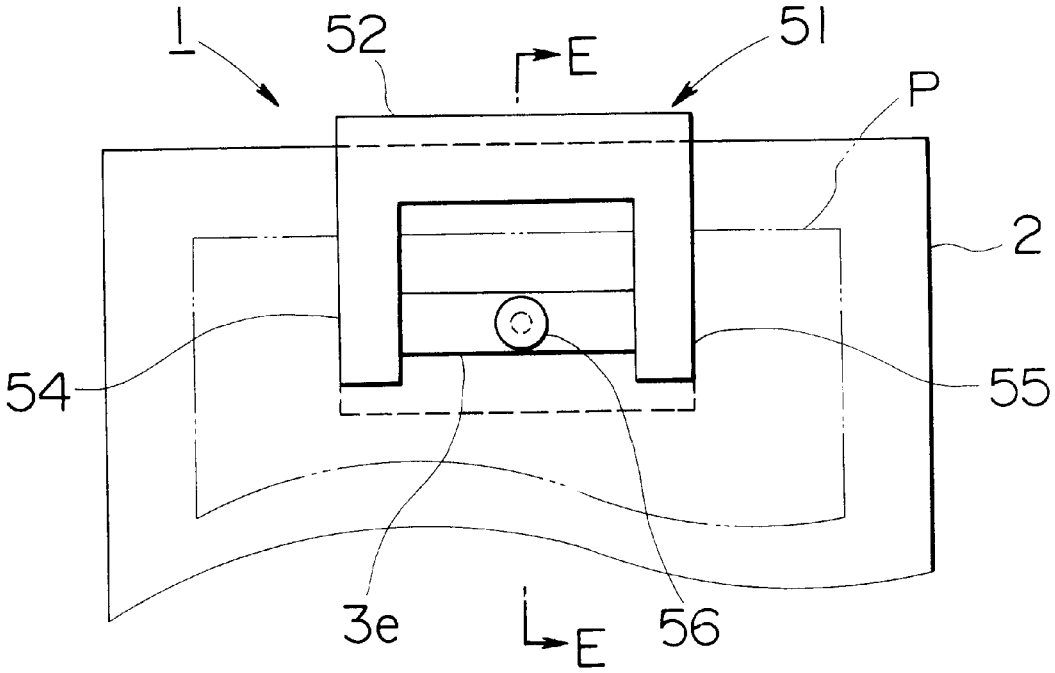
FIG. 13 is a plan view showing a significant part of the sheet fixing mechanism according to another modification.
Figure 14:
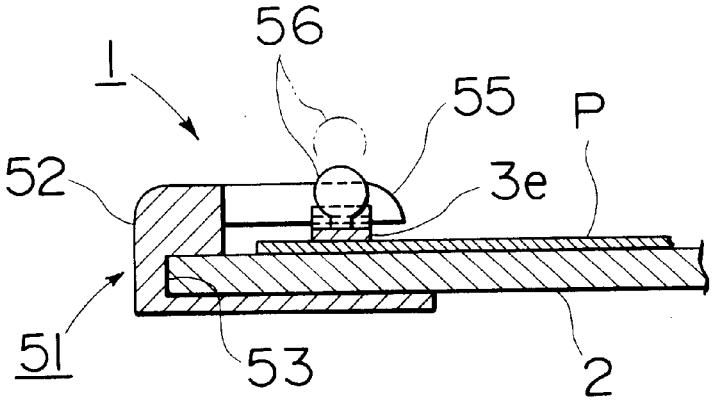
FIG. 14 is a cross-sectional view showing the sheet fixing mechanism, cut along a line XIV—XIV in FIG. 13.

Further, FIGS. 13 and 14 show another modification in which a sheet fixing unit 51, separately formed from the base plate 2, is attached to a side portion of the base plate 2. The sheet fixing unit 51 has a C-shaped fixing-unit main body 52, and a concave engaging portion 53 at a lower part of the fixing-unit main body 52. The side portion of the base plate 2 is inserted into the engaging portion 53, and is fixed by using adhesive. In this case, the base plate 2 may be removably attached to the engaging portion by using a screw or the like. Further, the fixing-unit main body 52 has a pair of right and left arms 54 and 55 at its upper portion, away from the upper surface of the base plate 2, and a buckling plate 3*e*, having a similar structure to that shown in FIGS. 1 and 2, between the arms 54 and 55. The buckling plate 3*e* includes a knob 5. The sheet fixing unit 51 having the above structure can be attached to stationery such as a cardboard laid under a writing pad or a sheet for calligraphy (sheet P), a file, and a clipboard (base plate 2), otherwise, the sheet fixing unit 51 can be independently used.

Figure 15:
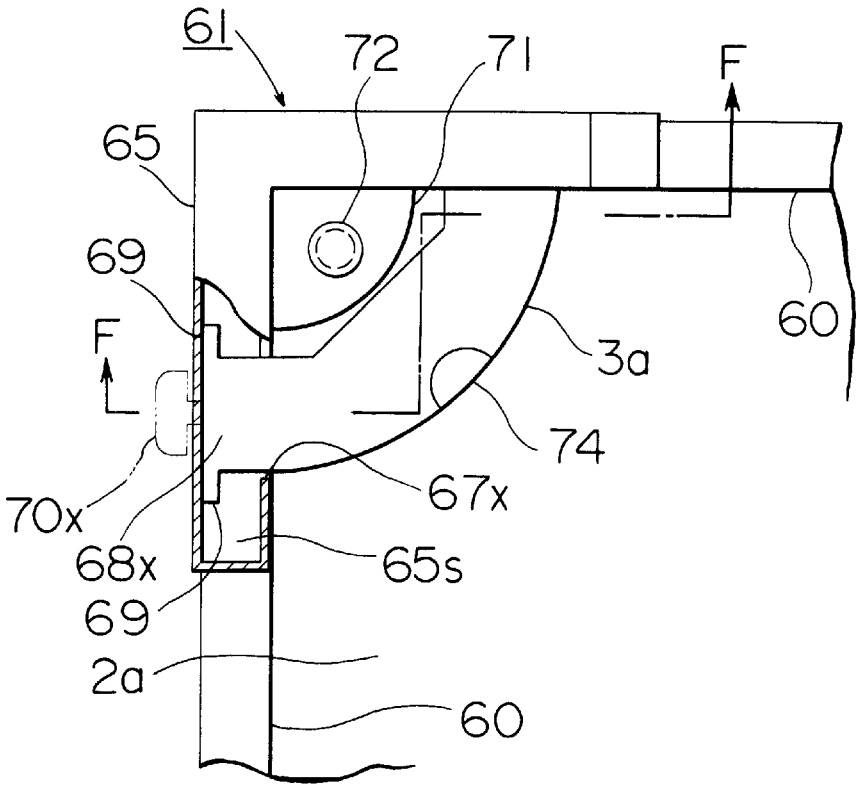
FIG. 15 is a plan view showing a significant part of the sheet fixing mechanism according to another modification.
Figure 16:
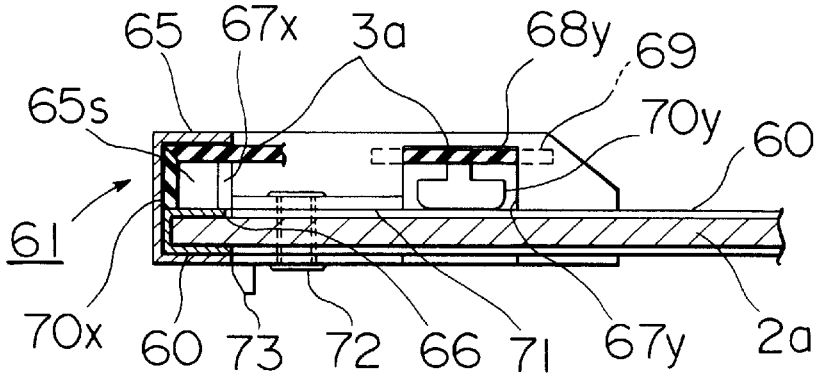
FIG. 16 is a cross-sectional view showing the sheet fixing mechanism, cut along a line XVI—XVI in FIG. 15.

On the other hand, FIGS. 15 and 16 show an example of a preferred structure used in actual manufacture.

Numeral 2*a* denotes a base-plate main body. The base-plate main body 2*a* may comprise a wooden plate or a pasteboard with a thickness of about 3 mm. The base-plate main body 2*a* is covered at almost all the edge portions with a plastic edge cover 60 having a U-shaped cross section. The base-plate main body 2*a* has sheet fixing units 61 at its four corners. As shown in FIG. 15, each sheet fixing unit 61 has an L-shaped plastic fixing unit base 65 integrally formed with the sheet fixing unit 61, and the buckling plate 3*a* attached to the fixing unit base 65. The fixing unit base 65 includes a hollow portion 65*s* inside, an opening 66 at its lower part, in which each corner of the base-plate main body 2*a* is inserted, and a pair of attaching portions 67*x* and 67*y* which are cut from the upper end of the opening 66 and to which the both ends of the buckling plate 3*a* are attached. On the other hand, the buckling plate 3*a* is integrally formed with hard rubber or the like, and it has attaching members 68*x* and 68*y*, at its both ends, at right angles with each other. The attaching members 68*x* and 68*y* respectively have projections 69, extending from the end portion in a width-wise direction of the buckling plate, for preventing the attaching member from slipping out. Further, the attaching members 68*x* and 68*y* have support members 70*x* and 70*y* bendable in a right-angular direction via a thin portion, with respect to the main body of the buckling plate 3*a*.

When assembling the above structure, the attaching members 68*x* and 68*y* of the buckling plate 3*a* are placed in the attaching portions 67*x* and 67*y* of the fixing unit base 65. Then, as shown in FIG. 16, the respective support members 70*x* and 70*y* are bent at the right angle to abut against an inner side wall of the fixing unit base 65, and the main body of the buckling plate 3*a* is placed in contact with an upper surface of the inner wall of the fixing unit base 65. In this state, the corner of the base-plate main body 2*a* is inserted into the opening 66, and an attaching member 71, provided at a central portion of the fixing unit base 65, and the base-plate main body 2*a* are connected by using a fixture 72 such as an eyelet or a rivet. Thus, the main body of the buckling plate 3*a* is positioned at a predetermined height from the base-plate main body 2*a,* and as shown in FIG. 16, lower ends of the respective support members 70*x* and 70*y* are fixed (regulated) by the base-plate main body 2*a* (edge cover 60). Note that numeral 73 denotes an aligning convex member having the same function as that of the aligning convex member 13. Numeral 74 denotes a concave portion formed by expanding a part of a central portion of the buckling plate 3*a,* to catch a finger, having a similar function to that of the knob 17.

The embodiment and the modifications have been explained in detail as above, however, the present invention is not limited to the above embodiment and modifications, and various changes, omission and addition can be arbitrarily made in the construction, shape and material of the parts, in accordance with necessity, within the spirit and scope of the present invention. For example, as the main purpose, the embodiment and modifications have been explained in a case where the present invention is applied to stationery, however, the present invention is also applicable to other tools such as a frame for holding a poster, a photograph or the like, and a bulletin board. Therefore, to appraise the public of the scope of the present invention, the following claims are made.

What is claimed is:

1. A sheet fixing mechanism, comprising:

a flat base plate on which a sheet is placed, said base plate having a rectangular outer perimeter;

a first resilient buckling plate straddling one corner of said outer perimeter and being selectively biased to one of two positions, namely a fixing position at which a first corner of the sheet placed on said base plate is fixed and a release position at which the first corner of the sheet is separated from said base plate; and a second resilient buckling plate straddling another corner of said outer perimeter and being selectively biased to one of two positions, namely a fixing position at which a second corner of the sheet placed on said base plate is fixed and a release position at which the second corner of the sheet is separated from said base plate.

2. The sheet fixing mechanism according to claim 1, wherein at least one of said first and second buckling plates is integrally formed with said base plate.

3. The sheet fixing mechanism according to claim 1, wherein at least one of said first and second buckling plates is separately formed from said base plate, and is fixedly attached to said base plate by postfixing.

4. The sheet fixing mechanism according to claim 1, wherein at least one of said first and second buckling plates is pivotally attached to said base plate.

5. The sheet fixing mechanism according to claim 1, wherein at least one of said first and second buckling plates is moved in an approximately perpendicular direction with respect to said base plate between said fixing position and said release position.

6. The sheet fixing mechanism according to claim 1, wherein at least one of said first and second buckling plates is moved in a direction approximately parallel to said base plate between said fixing position and said release position.

7. The sheet fixing mechanism according to claim 1, wherein at least one of said first and second buckling plates has one or more projections on a surface thereof facing said base plate.

8. The sheet fixing mechanism according to claim 7, wherein at least one of said one or more projections has a sharp distal end.

9. The sheet fixing mechanism according to claim 1, wherein at least one of said first and second buckling plates has a surface facing said base plate including adhesive material attachable and removable with respect to the sheet.

10. The sheet fixing mechanism according to claim 1, wherein said base plate has fixing members for fixing four corners of a small sheet.

11. The sheet fixing mechanism according to claim 1, wherein at least one of said first and second buckling plates is separately formed from said base plate, and is removably attached to said base plate by postfixing.

12. The sheet fixing mechanism according to claim 1, wherein at least one of said first and second buckling plates is formed of a resilient material and said at least one buckling plate is selectively biased to one of said two positions by its own resilience.

13. The sheet fixing mechanism according to claim 1, further comprising a handle attached to said first buckling plate for grasping by a user to selectively move said first bucking plate between said two positions.

14. The sheet fixing mechanism according to claim 13, wherein said handle is a knob attached to said buckling plate and extending in a direction away from said base plate.

15. A sheet fixing mechanism, comprising:

a flat base plate on which a sheet is placed, said base plate having a rectangular outer perimeter;

a first resilient buckling plate overlying a portion of one side of said outer perimeter and being selectively biased to one of two positions, namely a fixing position at which a first side of the sheet placed on said base plate is fixed and a release position at which the first side of the sheet is separated from said base plate; and a second resilient buckling plate overlying a portion of another side of said outer perimeter and being selectively biased to one of two positions, namely a fixing position at which a second side of the sheet placed on said base plate is fixed and a release position at which the second side of the sheet is separated from said base plate.

16. The sheet fixing mechanism according to claim 15, wherein at least one of said first and second buckling plates is formed of a resilient material and said at least one buckling plate is selectively biased to one of said two positions by its own resilience.

17. The sheet fixing mechanism according to claim 15, wherein at least one of said first and second buckling plates is pivotally attached to said base plate.

18. The sheet fixing mechanism according to claim 15, wherein at least one of said first and second buckling plates is moved in an approximately perpendicular direction with respect to said base plate between said fixing position and said release position.

19. The sheet fixing mechanism according to claim 15, wherein at least one of said first and second buckling plates is moved in a direction approximately parallel to said base plate between said fixing position and said release position.

20. The sheet fixing mechanism according to claim 15, wherein at least one of said first and second buckling plates has one or more projections on a surface thereof facing said base plate.

* * * * *